United States Patent [19]

Loladze et al.

[11] Patent Number: 4,894,957

[45] Date of Patent: Jan. 23, 1990

[54] APPARATUS FOR ABRASIVE MACHINING OF PLANAR SURFACES

[75] Inventors: Teimuraz N. Loladze; Boris I. Batiashvili; David S. Butskhrikidze, all of Tbilisi, U.S.S.R.

[73] Assignee: Gruzinsky Politekhnichesky Institut, Tbilisi, U.S.S.R.

[21] Appl. No.: 283,273

[22] PCT Filed: Mar. 3, 1988

[86] PCT No.: PCT/SU88/00051

§ 371 Date: Nov. 7, 1988

§ 102(e) Date: Nov. 7, 1988

[87] PCT Pub. No.: WO87/06951

PCT Pub. Date: Sep. 22, 1988

[30] Foreign Application Priority Data

Mar. 10, 1987 [SU] U.S.S.R. ..... 4201396

[51] Int. Cl.[4] ..... B24B 5/00

[52] U.S. Cl. ..... 51/131.1; 51/131.4

[58] Field of Search ..... 51/131.1, 131.3, 131.4, 51/132, 133, 141

[56] References Cited

U.S. PATENT DOCUMENTS 2,963,830 12/1960 Hook .
3,968,598 7/1976 Ogawa .

FOREIGN PATENT DOCUMENTS 471186 8/1975 U.S.S.R. .
1104762 4/1979 U.S.S.R. .
965740 10/1982 U.S.S.R. .
1364448 6/1986 U.S.S.R. ..... 51/131.4
2124114 2/1984 United Kingdom .

*Primary Examiner*—Frederick R. Schmidt
*Assistant Examiner*—M. Rachuba
*Attorney, Agent, or Firm*—Fleit, Jacobson, Cohn, Price, Holman & Stern

[57] ABSTRACT

In a machine tool for abrasive machining of planar surfaces having a bed (1) supporting a workhead (28), a faceplate (9) carrying an abrasive tool (11), which is mounted for rotation by means of a thrust bearing (13) on an annular support (12) attached to the bed (1) and which is rotated by a coaxial drive shaft (3) journalled in antifriction bearings (16), and an adjustable means for pressing the faceplate (9) against the annular support (12), comprising an air-powered diaphragm (21) having a hollow rod (15) through which extends the drive shaft (3), according to the invention, the annular support (12) has a coaxial bushing (14) in which the hollow rod (15) is mounted for axial movement and to which a casing (22) of the air-powered diaphragm (21) is attached, the antifriction bearings (16) of the drive shaft (3) being mounted in the hollow rod (15) and the drive shaft (3) being coupled to the faceplate (9) by means of an elastic member (8).

2 Claims, 1 Drawing Sheet

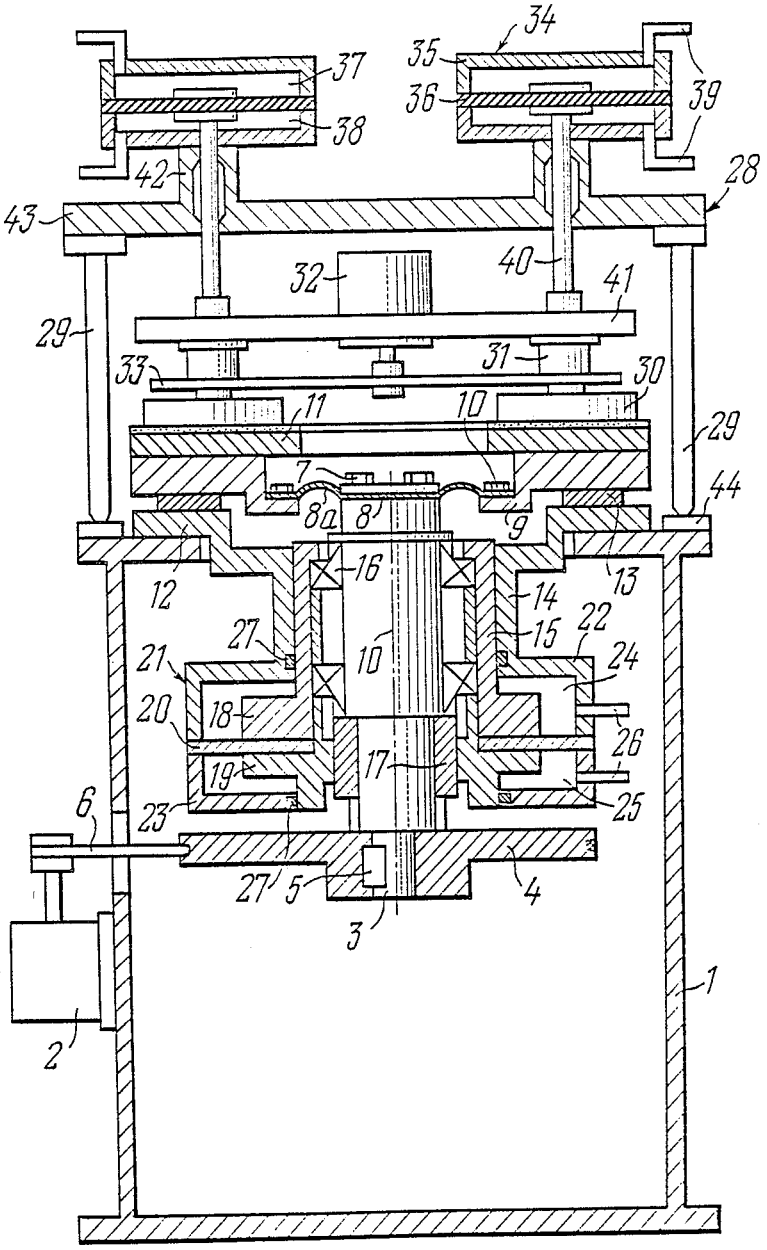
34
35
36
37
38
39
28
42
43
32
40
41
29
33
31
30
11
10
29
7
44
8a
8
9
12
16
13
14
22
27
15
21
10
24
20
18
26
19
17
6
23
25
27
5
4
3
1
2

APPARATUS FOR ABRASIVE MACHINING OF PLANAR SURFACES

FIELD OF THE ART

The invention relates to the mechanical engineering, and in particular, it deals with apparatuses for abrasive machining of planar surfaces.

STATE OF THE ART

Known in the art is a machine tool for abrasive machining (US,A, 2,963,830) comprising a bed, an abrasive wheel mounted on a faceplate which is mounted on a drive shaft. The drive shaft is journalled in a casing supported by the bed by means of a radial-thrust antifriction bearings. Rotation to the abrasive wheel is imparted by a drive through the drive shaft and the faceplate. A workhead mounted on the bed develops a force pressing the workpiece to an end face of the abrasive wheel.

This force directed perpendicularly with respect to the end face of the abrasive wheel gives rise to a moment with respect to the bearings and causes deformation of the drive shaft, faceplate and abrasive wheel so that high dimensional accuracy of the working surface of the tool, hence high accuracy of machining cannot be achieved. In addition, as the drive shaft is journalled by means of radial-thrust bearings, vibrations of the abrasive wheel occur because of a limited accuracy of such bearings and plays therein thus also lowering accuracy of machining..

Known in the art is an apparatus for grinding workpieces (GB,A, 2124114) comprising a bed having an annular support which carries a faceplate mounted by means of a thrust bearing for supporting workpieces, a drive shaft being rigidly and coaxially secured to the faceplate and journalled in a radial bearing mounted in the annular support of the bed. The faceplate is rotated by a drive through a gearing and the drive shaft. A driven gear of the drive shaft is rigidly secured to its lower end, and forces are applied to its upper end face through piston rods of hydraulic cylinders equally spaced along circumference of the gear thereby ensuring a preload in the thrust bearing.

Radial and axial forces are developed in this machine in the melting zone of the gears to give rise to a tilting moment acting in the axial section of the drive shaft to deform the drive shaft which tends to lift the faceplate from the thrust bearing thereby disrupting uniformity of distribution of the preload in the thrust bearing and causing its non-uniform wear. This results in a loss of smoothness of rotation and occurrence of vibrations to lower accuracy of machining with time. In addition, a minor disruption of equality of forces provided by the power cylinders gives rise to additional moments acting in various sections of the drive shaft thereby resulting in a further increase in the tilting moment applied to the faceplate, hence in an increase in negative phenomena that do not allow machining at high speeds to be carried out.

An apparatus for abrasive machining of planar surfaces (SU,A, 1104762) free from these disadvantages comprises a bed supporting a workhead and an annular support. The annular support carries, by means of a thrust bearing, a faceplate which is rotated by means of a coaxial drive shaft rigidly secured thereto, the upper end of the shaft being journalled in an antifriction bearing mounted in the annular support, the lower end of the shaft being connected by means of a clutch to a stub shaft of a driven member of a drive, which is journalled in antifriction bearings mounted in a casing supported by the bed.

The apparatus also comprises an adjustable means for pressing the faceplate against the annular support which is in the form of an air-powered diaphragm having its casing secured to the bed.

This prior art apparatus makes it possible to a ensure a more uniform load distribution at the thrust bearing because radial forces developed in the drive are eliminated and also owing to the coaxial arrangement of the air-powered diaphragm with respect to the drive shaft so that no tilting moments are generated in the axial planes. However, as the faceplate is pressed against the annular support through steps of the thrust bearing with a certain force, an increased runout of the lower end of the drive shaft occurs with a substantial length of the drive shaft so that non-uniform load is applied to the steps during rotation to result in non-uniform wear of both the steps of the thrust bearing and the bearing faces of the faceplate which, in the end of the day, results in a lower accuracy of machining.

In addition, the machine tool design is complicated, and the air-powered diaphragm and the driven member assembly supported by the bed have substantial axial size so as to compromise rigidy of structure and result in a large metal weight of the apparatus for abrasive machining.

DISCLOSURE OF THE INVENTION

The invention is based on the problem of providing a machine tool for abrasive machining of planar surfaces which is so constructed as to ensure high accuracy of machining owing to a more uniform pressure of a faceplate against an annular support so as to ensure uniform wear of steps of thrust bearings and bearing faces of the faceplate, while also facilitating manufacture of the faceplate and drive shaft owing to less stringent requirements imposed upon accuracy of their manufacture as well as providing for reduced size of assemblies and parts of the machine tool incorporated in the bed and for lowering metal weight.

This problem is solved by that in a machine tool for abrasive machining of planar surfaces, comprising a bed supporting a workhead, a faceplate carrying an abrasive tool, which is mounted for rotation by means of a thrust bearing on an annular support secured to the bed and which is rotated by means of a coaxial drive shaft journalled in antifriction bearings, and an adjustable means for pressing the faceplate against the annular support, comprising an air-powered diaphragm having a hollow rod, the drive shaft extending through the rod, according to the invention, the annular support has a coaxial bushing, and the hollow rod is mounted for axial movement in this bushing to which a casing of the air-powered diaphragm is attached, the antifriction bearings of the drive shaft being mounted in the hollow rod and the drive shaft being coupled to the faceplate by means of an elastic member.

Attaching the air-powered diaphragm to the coaxial bushing of the annular support makes it possible to achieve a substantial reduction of length of the drive shaft thus facilitating its manufacture and also to reduce size of the air-powered diaphragm assembly so as to lower metal weight.

The provision of the antifriction bearings of the drive shaft in the hollow rod reduces the number of fit surfaces of the drive shaft so as to further facilitate its manufacture because of less stringent requirements imposed on accuracy of manufacture.

With the provision of the hollow rod in the coaxial bushing of the annular support, radial forces acting upon the drive shaft are fully taken up, through the radial bearings, by the bushing of the annular support attached to the bed so that a drive member of the drive can be installed directly at the lower end of the drive shaft and an assembly of bearings of the driven member of the drive can be displaced with thus also lowering metal weight.

Connecting the drive shaft to the faceplate by means of an elastic member makes up for residual tilting moments developed because of inaccuracies of manufacture and assembly of these parts and assemblies thereby ensuring uniform pressure of the faceplate against the annular support, hence, uniform wear of steps of the thrust bearing and bearing face of the faceplate.

The elastic member is preferably made in the form of a disc having at least one concentric corrugation, which is coaxially mounted on the drive shaft.

The provision of the elastic member in the form of a disc coaxially mounted on the drive shaft makes it possible to center the faceplate with the abrasive tool with respect to the drive shaft.

The provision of at least one concentric corrugation on the elastic disc ensures more uniform distribution of forces in the thrust bearing owing to an increased elasticity with a given torque.

Therefore, a machine tool for abrasive machining of planar surfaces according to the invention ensures a high accuracy of abrasive machining and a substantial prolongation of service life of basic assemblies of the machine tool, while reducing metal weight thereof.

BRIEF DESCRIPTION OF THE ACCOMPANYING DRAWING

These and other features and advantages of the invention will become apparent from the following description of a specific embodiment thereof illustrated in the accompanying drawing, which schematically shows a machine tool for abrasive machining of planar surfaces according to the invention, a longitudinal section view.

PREFERRED EMBODIMENTS OF THE INVENTION

A machine tool for abrasive machining of planar surfaces such as supports of microchips, piezo-quartz and ceramic components, polyhedral throw-away hard metal and ceramic inserts, and the like, according to the invention, which is referred to hereinbelow as a machine according to the invention, has a bed 1 supporting a drive 2 which is in the form of an electric motor of any type suitable for this purpose.

The machine according to the invention comprises a shaft 3 having at the lower end thereof a pulley 4 which transmits, by means of a key 5, rotation from the drive 2 and a belt 6 to the shaft 3. Bolts 7 rigidly fasten to the upper end of the shaft 3 an elastic member 8 coaxial with the shaft, the bolts being equally circumferentially spaced. The elastic member 8, made of a metal capable of withstanding elastic deformations, is in the form of a disc such as a flat spring or have at least one concentric corrugation 8*a*.

The peripheral portion of the elastic member 8 is attached to a faceplate 9 by means of bolts 10 equally spaced along circumference, in a concentric bore coaxially with the faceplate.

The machine also has an abrasive tool 11 in the form of a face-grinding wheel having its outside and inside diameters chosen to provide the necessary working surface area depending on type and dimensions of workpieces.

The abrasive tool 11 is coaxially secured to the faceplate 9 by means of bolts (not shown in the drawing).

The machine has an annular support 12 rigidly secured to the bed 1 by means of bolts (not shown in the drawing). which are equally spaced along circumference.

A thrust bearing 13 is concentrically attached to the annular support 12 to support the faceplate 9.

The thrust bearing 13 is in the form of steps with an antifriction coating face towards the faceplate 9. To lower the coefficient of friction, a liquid lubricant is supplied to the thrust bearing 13 through a lubrication system (not shown in the drawing).

The thrust bearing may also be in the form of a hydrodynamic, hydrostatic or aerostatic thrust bearing.

The annular support 12 has a coaxial bushing 14 in which a hollow rod 15 is mounted for axial movement. Mating surfaces of the bushing 14 and hollow rod 15 are machined with a high accuracy to avoid relative rotation by a bending moment occurring from tension of the belt 6. In this embodiment the bushing 14 is integral with the annular support 12, but it can also be made in the form of an individual part and secured to the annular support 12.

The hollow rod 15 is in the form of a sleeve having in the hole thereof radial-thrust antifriction bearings 16 of any appropriate known type that can take up radial and axial loads. Preload in the bearings 16 is obtained by means of a nut 17.

The shaft 3 is mounted in the inner races of the radial-thrust bearings 16.

A flange 18 of the hollow rod 15 supports, by means of a ring 19, an inner part of a membrane 20 of an air-powered diaphragm 21 having a casing 22 thereof mounted on a lower part (in the drawing) of the bushing 14. An end plate 23 serves for attaching the outer part of the membrane 20 to the casing 22 so as to define two chambers 24 and 25. Pipes 26 are provided in the casing 22 of the air-powered diaphragm 21 for supplying compressed air at different pressures to the chambers 24 and 25 to vary force with which the faceplate 9 is pressed against the annular support 12. The air-powered diaphragm 21 also has annular seals 27 to prevent air from leaking from the chambers 24 and 25 of the air-powered diaphragm 21.

The machine also has a workhead 28 which is mounted on the bed by means of abutments 29.

The workhead 28 has a means for clamping workpieces. In this embodiment two means for clamping are used (it is understood that three and more such means can be used), each having a holder 30 having in its surface facing towards the abrasive tool 11 receptacles (not shown in the drawing) for receiving workpieces (not shown in the drawing). The holders are attached to spindles 31 running in parallel with the shaft 3 and equally spaced therefrom.

The spindles 31 are operatively connected to a drive which is in the form of an electric motor of any appropriate known type, by means of a belt 33 and pulleys (unreferenced) provided on a shaft of the drive 32 (unreferenced and on the spindles 31.

The workhead of the machine also has a means 34 for pressing workpieces against the abrasive tool 11. In this specific embodiment, two pressure means are used which are located symmetrically with respect to the shaft 3.

Each pressure means 34 has a chamber 35 incorporating a membrane 36 dividing the chamber 35 into two spaces 37 and 38 communicating, via pipes, with a compressed air source (not shown in the drawing) and with an air discharge line (not shown in the drawing). Each membrane 36 has its periphery attached to the wall of the chamber 35, and the central portion of the membrane is secured to an upper end (in the drawing) of a tailstock 40 having its lower end rigidly secured to a plate 41 which common for the means 34. The plate 41 is designed to transmit force to the means for clamping workpieces and further to the abrasive tool 11. The tailstocks 40 run in parallel with the shaft 3 and symmetrically with respect thereto through guide members 42 integral with a casing 43 of the workhead 28.

The machine bed 1 also has adjusting spacers 44 which are placed at three point symmetrically with respect to the shaft 3. The adjusting spacers 44 are made very accurately in thickness and are chosen in accordance with thickness of workpieces. The machine for abrasive machining of planar surfaces according to the invention functions in the following manner.

For placing the holders 30 containing workpieces, compressed air is supplied to the lower spaces 38 of the chamber 35 of the pressure means 34. The membranes 36 are bent to transmit forces to the tailstocks 40 which move in the guide members 42 of the casing 43 away from the abrasive tool 11 together with the plate 41 and spindles 31. In this position, the distance from datum surfaces (not shown) of the spindles 31 to a working face of the abrasive tool 11 (unreferenced) is greater than thickness of the holders 30 containing workpieces, and this distance is set up by adjusting the position of the casing 43 of the workhead 28 with respect to the bed 1 by means of the adjusting spacers 44.

At the same time, compressed air is supplied to the space 24 of the air-powered dispharagm 21. The membrane 20 transmit force to the hollow rod 15 which moves down (in the drawing) in the hole of the bushing 14. The radial-thrust antifriction bearings 16 and the shaft 3 journalled therein and carrying the pulley 4 also move together with the hollow rod to deform the corrugated portion of the elastic member 8 and to press the faceplate 9 against the thrust bearing 13. The value of pressure of compressed air in the chamber 24 depends on pressure exerted by the faceplate 9 upon the thrust bearings 13 which is chosen in such a manner as to provide optimum conditions for operation of the thrust bearing 13.

The abrasive tool 11 is rotated the drive 2 through the belt 6, pulley 4, shaft 3, elastic member 8, and faceplate 9. At the same time, the spindles 31 are rotated by the drive 32 through the belt 33 and pulleys (unreferenced). The holders 30 containing workpieces (not shown) are fed into a space between the abrasive tool 11 and spindles 31, e.g. by means of a known manipulator. Compressed air is supplied to the spaces 37 of the chambers 35 of the pressure means 34 at a predetermined pressure. The membranes 36 transmit force to the tailstocks 40 which move in the guide members 42 of the casing 43 towards the abrasive tool 11 together with the spindles 31. As the spindless 31 come closer to the holders 30, the latter come in contact with the spindles 31 with simultaneous alignment of their axes (not shown) and the workpieces (not shown) received in the holders come in touch with the working surface (unreferenced) of the abrasive tool 11 so as to provide a pressure force in the cutting zone. The holders 30 are rotated by forces of friction developed between the datum surfaces (unreferenced) of the spindles 31 and the surfaces of the holders 30 (unreferenced) which are in contact therewith. At the same time, compressed air at a predetermined pressure is admitted to the space 25 of the air-powered diaphragm 21, and the membrane 20 creates a compensating force at the faceplate 9, which is about equal to forces created by the means for pressing the workpieces against the abrasive tool 11 by means of the hollow rod 15, radial-thrust bearings 16 of the shaft 3 and elastic member 8.

Therefore, the thrust bearing 13 is always loaded with a force which is optimal therefor. Annularly uniformly distributed loads act thereupon, except for a difference of loads which appears because of inaccuracy of manufacture of parts which is made up for by means of the elastic member 8. Forces caused by tension of the belt are taken up by the bushing 14 of annular support 12.

INDUSTRIAL APPLICABILITY

The invention may be most efficiently used for precision grinding, polishing and lapping of planar surfaces, especially such as piezo-quartz resonators, supports for microchips, throw-away hard metal inserts, mineral ceramic and other composition materials, jewelry.

The apparatus for abrasive machining of planar surfaces according to the invention may also be used as precision spindle or worktable for carrying out other cutting processes involving axial loads.

We claim:

1. A machine tool for abrasive machining of planar surfaces, comprising a workhead (28) mounted on a bed (1), a faceplate (9) carrying an abrasive tool (11), mounted for rotation by means of a thrust bearing (13) on an annular support (12) secured to the bed (1) and rotated by means of a coaxial drive shaft (3) journalled in antifriction bearings, and an adjustable means for pressing the faceplate (9) against the annular support (12), comprising an air-powered diaphragm (21) having a hollow rod, the drive shaft (3) extending through the hollow rod, characterized in that the annular support (12) has a coaxial bushing (14) in which the hollow rod (15) is mounted for axial movement and which supports a casing (22) of the air-powered diaphragm (21), and in that the antifriction bearings (16) of the drive shaft (3) are mounted on the hollow rod (15), the drive shaft (3) being coupled to the faceplate (9) by means of an elastic member (8).

2. A machine tool according to claim 1, characterized in that the elastic member (8) is made in the form of a disc having at least one concentric corrugation **(8*a*), which is coaxially mounted on the drive shaft (3)**.

* * * * *

UNITED STATES PATENT AND TRADEMARK OFFICE

CERTIFICATE OF CORRECTION

PATENT NO. : 4,894,957

DATED : January 23, 1990

INVENTOR(S) : Teimuraz N. Loladze; Boris I. Batiashvili; David S. Butskhrikidze; Gennady L. Mamulashvili It is certified that error appears in the above-identified patent and that said Letters Patent is hereby corrected as shown below:

On the title page, at block [75], add the following inventor: --Gennady L. Mamulashvili--.

Signed and Sealed this

Tenth Day of September, 1991

*Attest:*

*Attesting Officer*

HARRY F. MANBECK, JR.

*Commissioner of Patents and Trademarks*